US009476681B2

(12) United States Patent
Saxby

(10) Patent No.: US 9,476,681 B2
(45) Date of Patent: Oct. 25, 2016

(54) NON-LETHAL TELESCOPICALLY EXPANDING TRAINING CARTRIDGE FOR SELF LOADING GUNS

(71) Applicant: UTM IP LIMITED, Mildenhall (GB)

(72) Inventor: Michael Ernest Saxby, Eastbourne (GB)

(73) Assignee: UTM IP LIMITED, Mildenhall (GB)

( * ) Notice: Subject to any disclaimer, the term of this patent is extended or adjusted under 35 U.S.C. 154(b) by 0 days.

(21) Appl. No.: 14/383,827

(22) PCT Filed: Feb. 27, 2013

(86) PCT No.: PCT/GB2013/000085

§ 371 (c)(1),
(2) Date: Sep. 8, 2014

(87) PCT Pub. No.: WO2013/132204

PCT Pub. Date: Sep. 12, 2013

(65) Prior Publication Data

US 2015/0090146 A1 Apr. 2, 2015

(30) Foreign Application Priority Data

Mar. 7, 2012 (GB) ..... 1204008.5

(51) Int. Cl.
*F42B 5/045* (2006.01)

(52) U.S. Cl.
CPC ..... *F42B 5/045* (2013.01)

(58) Field of Classification Search
CPC ..... F42B 5/045; F42B 5/184
USPC ..... 102/444–447, 498, 502
See application file for complete search history.

(56) References Cited

U.S. PATENT DOCUMENTS

| | | | | |
|---|---|---|---|---|
| 5,359,937 | A | 11/1994 | Dittrich | |
| 6,564,719 | B2 | 5/2003 | Saxby | |
| 8,327,767 | B2 * | 12/2012 | Lafortune | 102/439 |

FOREIGN PATENT DOCUMENTS

| | | |
|---|---|---|
| GB | 2446600 | 8/2008 |
| WO | 00/09965 A1 | 2/2000 |
| WO | 2005/054775 A1 | 6/2005 |

OTHER PUBLICATIONS

Great Britain Office Action for Application No. GB1204008.5, 3 pages, dated Jul. 4, 2012.
International Search Report and Written Opinion for Application No. PCT/GB2013/000085, 13 pages, dated Jun. 10, 2013.

* cited by examiner

*Primary Examiner* — Reginald Tillman, Jr.
(74) *Attorney, Agent, or Firm* — Nelson Mullins Riley & Scarborough LLP; Anthony A. Laurentano

(57) ABSTRACT

A cartridge for use in a gun comprises a case, a gas generator, a piston, a stopper, and at least one channel for the passage of gas in and/or around the stopper wherein the piston is axially slideably contained in the case, the gas generator is located within the case adjacent a first end of the case, and the stopper is slideably contained within the piston for closing the at least one channel.

29 Claims, 3 Drawing Sheets

NON-LETHAL TELESCOPICALLY EXPANDING TRAINING CARTRIDGE FOR SELF LOADING GUNS

RELATED APPLICATIONS

This application is a 35 U.S.C. 371 national stage filing of International Application PCT/GB2013/000085, filed Feb. 27, 2013, which claims priority to Great Britain Patent Application No. 1204008.5 filed on Mar. 7, 2012 in Great Britain. The contents of the aforementioned applications are hereby incorporated by reference.

The present invention relates to ammunition, particularly non-lethal cartridges intended for use in training and war games. More especially, the invention relates to a non-lethal telescopically expanding training cartridge for self loading guns in which rearwards movement of a portion of the cartridge is used to initiate the recycling of an automatic or semi-automatic firearm. The cartridge includes a stopper which closes channel(s) shutting off gas flow.

BACKGROUND

Telescopically expanding training cartridges are known. Examples are disclosed by U.S. Pat. No. 5,359,937, WO00/09965 and U.S. Pat. No. 6,564,719 and these disclosures are discussed below.

The cartridge disclosed by U.S. Pat. No. 5,359,937 allows a free flow of gas generated in the cartridge to reach and then propel a bullet through the barrel of a host gun at the same time as the cartridge telescopically expands. The disclosed design has many disadvantages including:

1. Expansion of the cartridge in the gun while the bullet is in the barrel of the gun causes movement of the gun and a loss of accuracy.
2. The velocity of the bullet fired from the gun is dependent on the force required to be generated by the cartridge to open the gun. In this regard, if there is a delay in cycling the gun, this leads to a delay in propelling the bullet and hence there is a velocity variation.
3. During the time that there is a free flow of gas to the bullet, an excessive amount of gas is required to expand the cartridge.

The design of cartridge disclosed in WO00/09965 addresses a number of the disadvantages discussed above, namely:

1. The free flow of gas to the bullet is cut off as the cartridge expands to cycle the gun. In light of this, the cartridge disclosed in this document requires less gas compared to the cartridge disclosed by U.S. Pat. No. 5,359,937.
2. The bullet has exited or substantially exited the gun before the cartridge expands to cycle the gun i.e. less movement of the gun, which leads to better accuracy.

However, the velocity of the bullet is controlled by the expansion of the cartridge which in turn is controlled by the force required to cycle the gun. This results in variations in velocity from one gun compared to another gun and from guns produced by one manufacturer compared to those produced by another manufacturer.

The disclosed cartridge design is also very expensive to manufacture.

The design of cartridge disclosed in U.S. Pat. No. 6,564,719 overcomes a number of the disadvantages discussed above, but this cartridge requires two gas generating sources. In this regard, a first rear gas generator is activated by the firing pin of a gun and it fires a second bullet propelling gas generator. The first gas generator cycles the gun after it has fired the second gas generator and the bullet has left the barrel of the host gun.

Cartridges according to this known design are expensive to manufacture and they suffer from the disadvantage that there are inherent variations in bullet velocity caused by the inability to accurately control the volume of gas generated by the bullet propelling gas generator.

The present invention addresses the problems and disadvantages of the known cartridges.

Remarkably, a cartridge according to the invention has been found to have the advantages of improved shot to shot and gun type to gun type bullet velocity. In addition, the internal working components of a cartridge according to the invention control the velocity of a bullet. Advantageously, the velocity of the bullet is not dependent on the gun.

It will be apparent that accurate control of the velocity of a bullet reduces the risk of injury and improves safety.

In addition, the invention provides the advantage that, only one gas generator is required. This reduces manufacturing cost and pollution compared to known cartridges.

STATEMENT OF INVENTION

According to the invention, in a first aspect there is provided a cartridge for use in a gun, the cartridge having a case, a gas generator, a piston, a stopper, and at least one channel for the passage of gas in and or around the stopper wherein the piston is axially slideably contained in the case, the gas generator is located within the case adjacent a first end of the case, and the stopper is slideably contained within the piston for closing the at least one channel.

In use, gas is generated or expelled by the gas generator upon contact with the firing pin of a host gun. The gas can flow through at least one channel in and/or around the stopper and this increases pressure within the casing. The increase in pressure forces the piston to move in the case away from the gas generator towards a second end of the case. The gas is forced through at least one channel in the piston against a bullet located adjacent the second end of the case pushing the bullet away from the case and out of the host gun. The increase in pressure forces the stopper to move in the piston away from the gas generator towards the second end of the case thereby closing the channel(s). After the channel(s) have been closed, the pressure telescopically expands the casing towards a breech block of the gun to cycle the gun.

Initially, gas from the generator can flow through channel(s) in and/or around the stopper and exert pressure on the bullet. However, as the gas pressure rises, the flow of gas past and/or through the stopper causes the stopper to move thereby shutting the channel(s) and preventing gas flow to the bullet and then to atmosphere.

After the stopper has been caused to move thereby shutting the channel(s), the gas pressure causes the cartridge to expand to cycle the gun.

Preferably, the case is cylindrical.

Preferably, a hollow piston is slideably disposed within the case.

Preferably, the cartridge comprises only a single gas generator.

Preferably, the cartridge further comprises a bullet.

Preferably the bullet, otherwise referred to as a projectile, is mounted in or on a recessed seat in the second end of the piston, and the gas channel communicates with the recessed seat. The recessed seat is typically of a tapering configuration, the trailing end of the bullet being force-fitted into the seat. However, it will be appreciated that alternative arrangements for mounting the bullet or other projectile in or on the cartridge may be employed, for example, the projectile may sit across the recessed seat.

The arrangement of the present invention ensures that the bullet is discharged before significant movement of the piston has taken place. Once the bullet has been ejected from the cartridge, movement of the stopper relative to the piston causes the channel to close thereby preventing gas from passing through the second end of the piston. Thus, the full force of the expanding gas is then used to drive the piston to move relative to the case to recycle the gun. By ensuring that the bullet is discharged before the gun is recycled, any movement of the gun barrel resulting from vibration of the gun during recycling is minimised or avoided, and it has been found that this greatly increases the accuracy of the firing.

A further advantage of the present invention is provided by the reduction in the number of gas generators combined with a simple gas switch which allows plastics components or off the shelf components to be used. This reduces the manufacturing cost while substantially improving the function of the cartridge.

In a first embodiment, the stopper is generally cylindrical and channels are defined axially through the stopper from a first end of the stopper to a second end of the stopper. In this embodiment, preferably, the cartridge comprises a plurality of channels for the passage of gas through the stopper. Preferably, there are at least two channels. More preferably, there are three or more channels. Most preferably, there are three channels.

Preferably, the channels through the stopper are spaced radially equidistant from each other. Preferably, channels through the stopper are spaced axially equidistant from each other.

Preferably, the first end of the stopper is located adjacent a first end of the piston in proximity to the gas generator. Preferably, the first end of the stopper is planar.

Preferably, the second end of the stopper is conical. Preferably, the channels are defined through the stopper and they exit the stopper proximal to its second end adjacent the base of the cone forming the second end.

When gas is generated or expelled by the gas generator, the gas pressure in the cartridge builds. Initially the gas flows through the channels until the gas pressure forces the stopper to move in the piston towards a second end of the case. The second end of the stopper is forced to abut a corresponding internal surface of the piston. Preferably, the corresponding surface is of relatively soft material. Preferably it is of plastics material. This closes the channel(s).

After the channel(s) have been closed, the case is forced by gas pressure to move relative to the stopper and the piston, thereby telescopically expanding the cartridge.

In a second embodiment, the stopper is generally a disk and channels are defined axially through the stopper from a first end of the stopper to a second end of the stopper. In this embodiment, preferably, the cartridge comprises a plurality of channels for the passage of gas through the stopper. Preferably, there are at least two channels. More preferably, there are three or more channels. Most preferably, there are three channels.

Preferably, the channels through the stopper are spaced radially equidistant from each other. Preferably, channels through the stopper are spaced axially equidistant from each other.

Preferably, the first end of the stopper is located adjacent a first end of the piston in proximity to the gas generator. Preferably, the first end of the stopper is planar.

Preferably, the second end of the stopper comprises a member atop the disk. Preferably, the channels are defined axially through the stopper and they exit the stopper through an annual surface of the disk radially distal to the member.

When gas is generated or expelled by the gas generator, the gas pressure in the cartridge builds. Initially the gas flows through the channels until the gas pressure forces the stopper to move in the piston towards a second end of the case. The second end of the stopper having the member atop is forced to abut a corresponding surface of the piston. In this regard, the annular surface of the disk abuts an annual surface of the piston and the member is sized to fit tightly into a channel in the piston. Preferably, the member has external dimensions the same as the internal dimensions of a channel in the piston. This closes the channel(s).

After the channel(s) have been closed, the case is forced by gas pressure to move relative to the stopper and the piston, thereby telescopically expanding the cartridge.

In a third embodiment, the stopper is generally a sphere and a channel are defined around the stopper.

Preferably, the stopper is located adjacent a first end of the piston in proximity to the gas generator.

When gas is generated or expelled by the gas generator, the gas pressure in the cartridge builds. Initially the gas flows through the channel until the gas pressure forces the stopper to move in the piston towards a second end of the case. The stopper is forced to abut an annular surface inside the piston. In this regard, the stopper is sized to fit tightly into a channel in the piston and the stopper is deformable when it abuts the annular surface inside the piston. This closes the channel.

After the channel(s) have been closed, the case is forced by gas pressure to move relative to the stopper and the piston, thereby telescopically expanding the cartridge.

DETAILED DESCRIPTION

Additional features and advantages of the present invention are described in, and will be apparent from, the description of the presently preferred embodiments which are set out below with reference to the drawings in which.

For the purposes of clarity and a concise description features are described herein as part of the same or separate embodiments, however it will be appreciated that the scope of the invention may include embodiments having combinations of all or some of the features described.

Within the context of the present application, the word "comprises" is taken to mean "includes among other things", and is not taken to mean "consists of only".

The terms stopper or "gas switch" as used herein are interchangeable and have the same meaning.

The term "about" is interpreted to mean +/−20%, more preferably +/−10%, even more preferably +/−5%, most preferably +/−1%.

As described above, the invention provides a novel cartridge.

Figure 1:
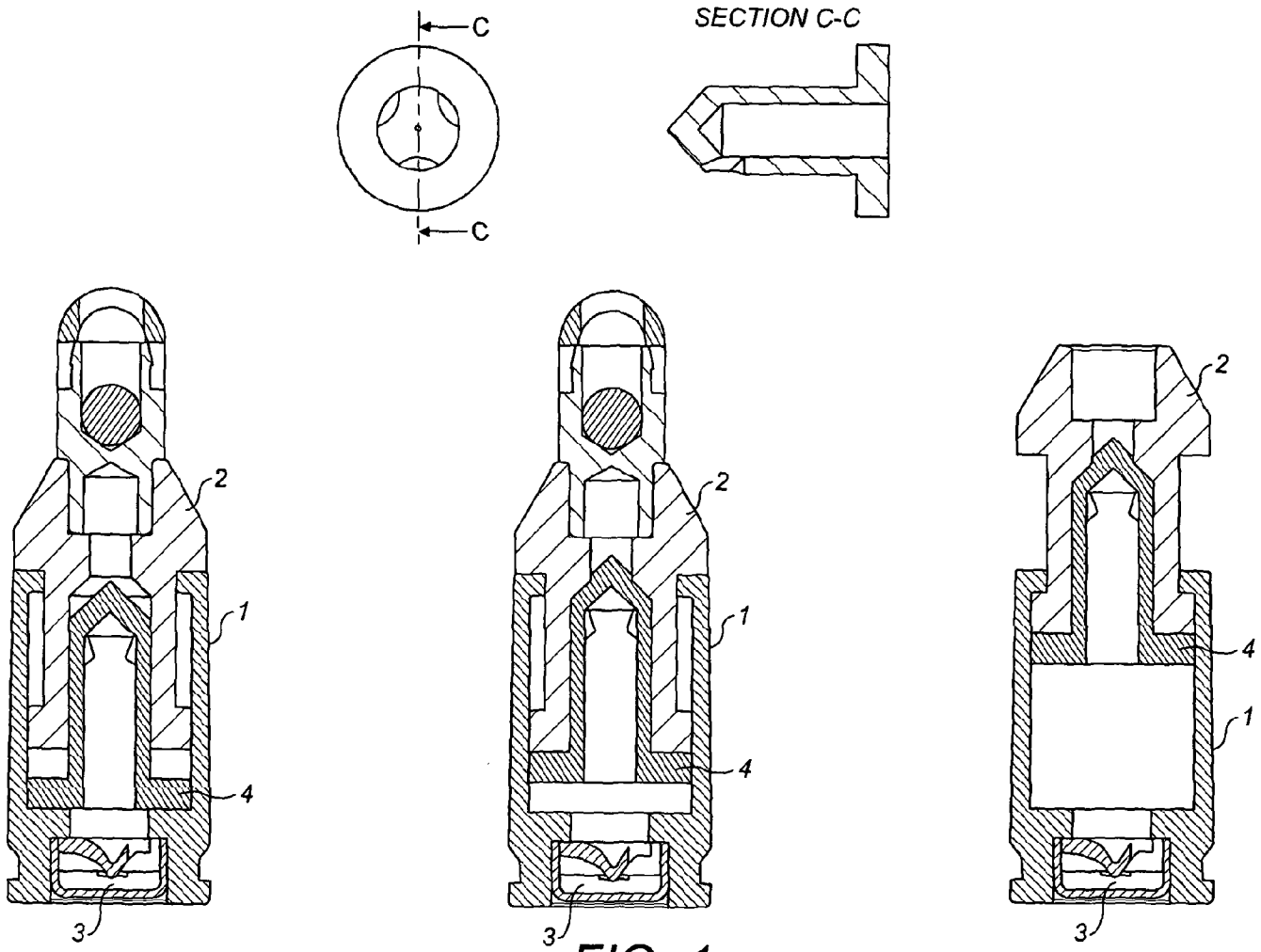
FIG. 1 shows a first embodiment of the invention as described above.

As seen in FIG. 1, a cartridge according to the invention comprises a gas generator [3] which is initiated by the firing pin of a host gun. The gas from the generator has a free passage to the bullet via vents in/around the gas switch [4].

As the gas pressure rises the flow of gas past/through the gas switch [4] causes the switch to close shutting off the gas flow to the bullet and then to atmosphere.

The gas pressure continues to expand the cartridge to cycle the gun.

As shown in FIG. 1, the stopper [4] is generally cylindrical and channels are defined axially through the stopper [4] from a first end of the stopper to a second end of the stopper [4]. The cartridge comprises three channels for the passage of gas through the stopper [4].

The channels through the stopper [4] are spaced radially equidistant from each other and axially equidistant from each other.

The first end of the stopper [4] is planar and it is located adjacent a first end of the piston [2] in proximity to the gas generator [3].

The second end of the stopper [4] is conical. The channels are defined through the stopper [4] and they exit the stopper [4] proximal to its second end adjacent the base of the cone forming the second end.

When gas is generated or expelled by the gas generator [3], the gas pressure in the cartridge builds. Initially the gas flows through the channels until the gas pressure forces the stopper [4] to move in the piston [2] towards a second end of the case [1]. The second end of the stopper [4] is forced to abut a corresponding internal surface of the piston [2]. The corresponding surface is of plastics material. This closes the channels.

After the channels have been closed, the case [1] is forced by gas pressure to move relative to the stopper [4] and the piston [2], thereby telescopically expanding the cartridge.

Figure 2:
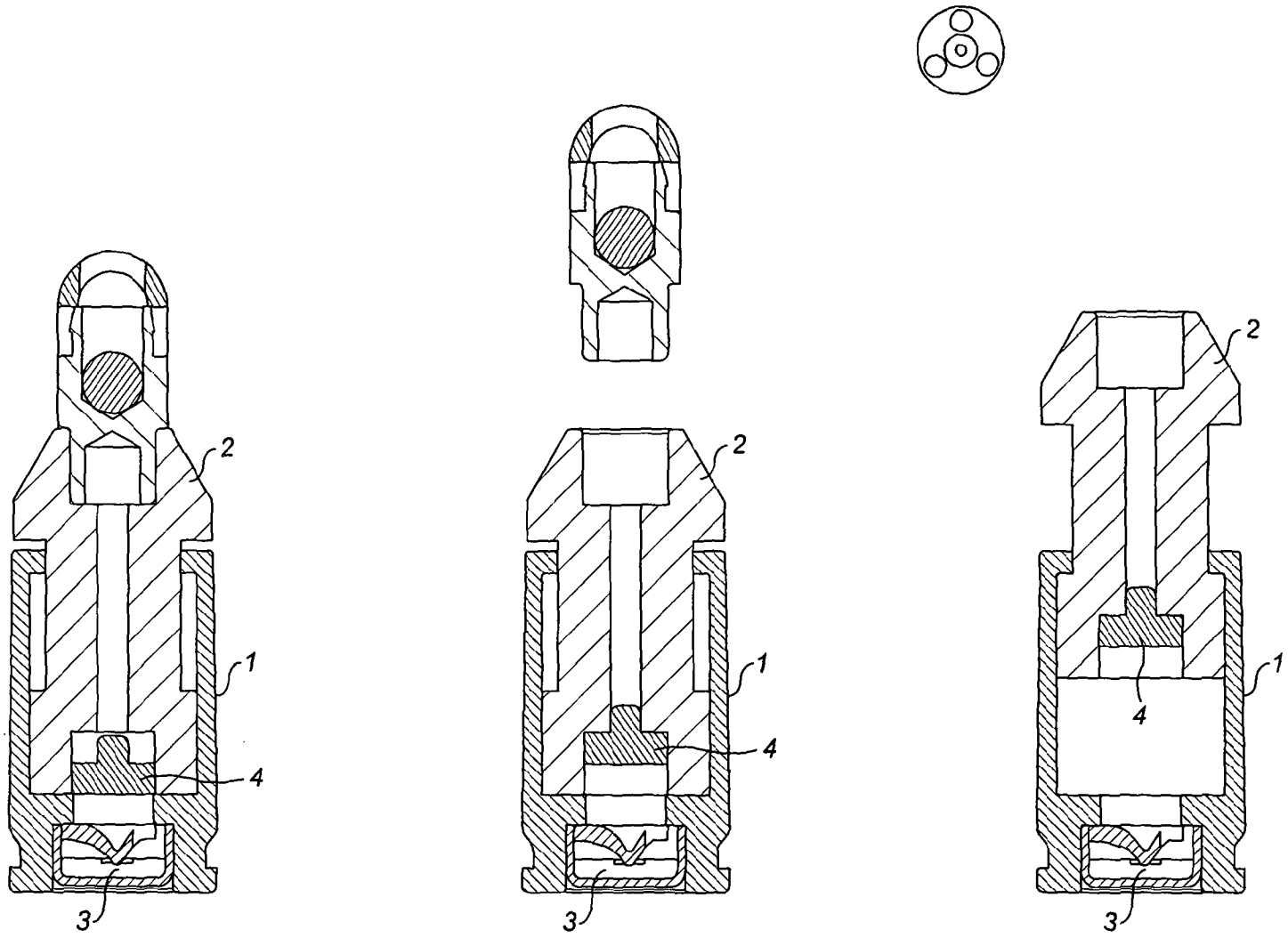
FIG. 2 shows a second embodiment of the invention as described above.

As shown in FIG. 2, in an alternative embodiment the stopper [4] is generally a disk and channels are defined axially through the stopper [4] from a first end of the stopper [4] to a second end of the stopper [4]. The cartridge comprises a three channels for the passage of gas through the stopper [4].

Preferably, the channels through the stopper [4] are spaced radially equidistant from each other and axially equidistant from each other.

The first end of the stopper [4] is planar and it is located adjacent a first end of the piston [2] in proximity to the gas generator [3].

The second end of the stopper [4] comprises a member atop the disk. The channels are defined axially through the stopper [4] and they exit the stopper [4] through an annular surface of the disk radially distal to the member.

When gas is generated or expelled by the gas generator [3], the gas pressure in the cartridge builds. Initially the gas flows through the channels until the gas pressure forces the stopper [4] to move in the piston [2] towards a second end of the case [1]. The second end of the stopper [4] having the member atop is forced to abut a corresponding surface of the piston [2]. In this regard, the annular surface of the disk abuts an annual surface of the piston [2] and the member is sized to fit tightly into a channel defined in the piston [2]. Preferably, the member has external dimensions the same as the internal dimensions of a channel in the piston [2]. This closes the channels.

After the channels have been closed, the case [1] is forced by gas pressure to move relative to the stopper [4] and the piston [2], thereby telescopically expanding the cartridge.

Figure 3:
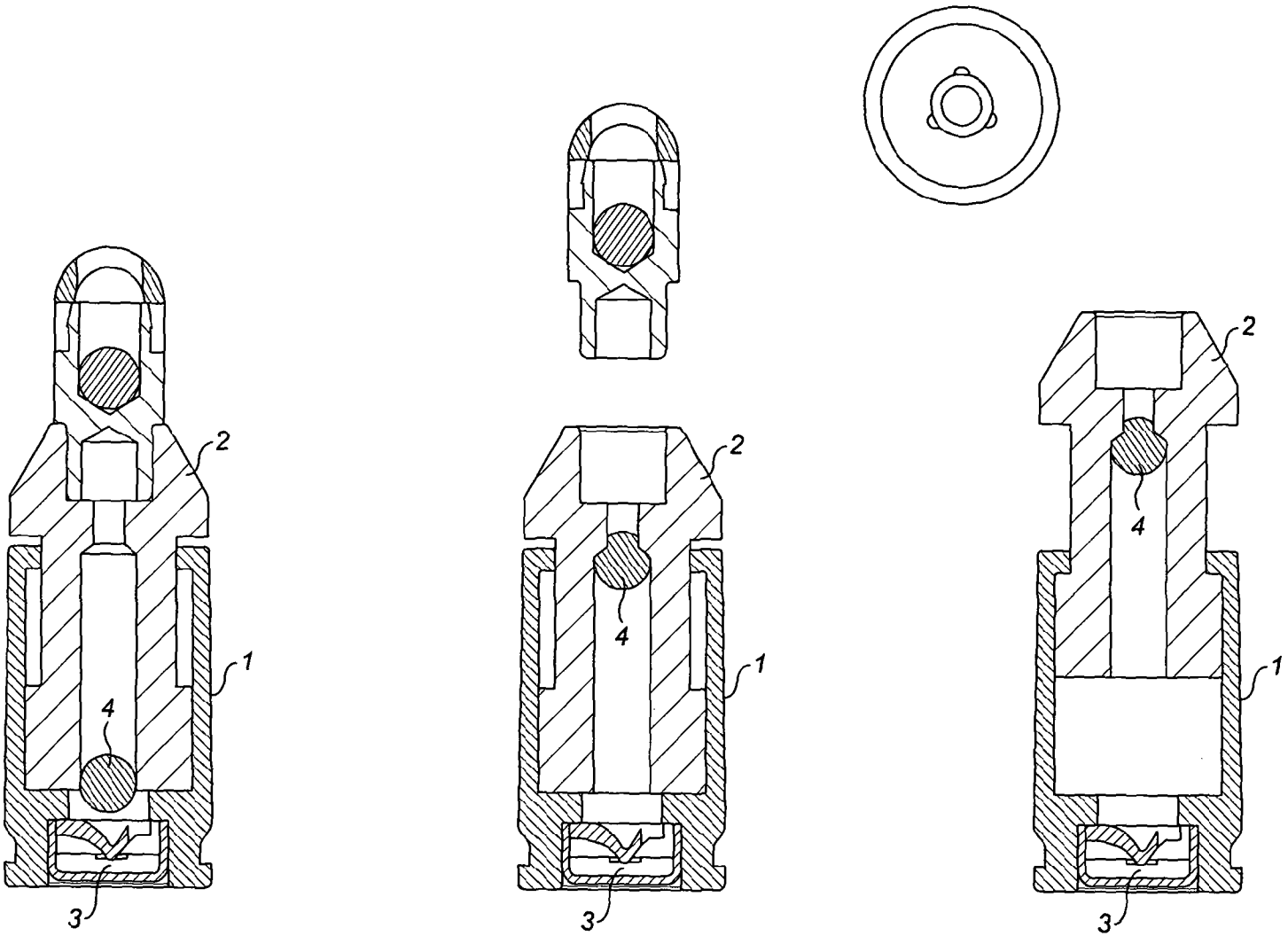
FIG. 3 shows a third embodiment of the invention as described above.

As shown in FIG. 3, in an alternative embodiment the stopper [4] is generally a sphere and a channel is defined around the stopper [4].

The stopper [4] is located adjacent a first end of the piston [2] in proximity to the gas generator [3].

When gas is generated or expelled by the gas generator [3], the gas pressure in the cartridge builds. Initially the gas flows through the channel until the gas pressure forces the stopper [4] to move in the piston [2] towards a second end of the case [1]. The stopper is forced to abut an annular surface inside the piston [2]. In this regard, the stopper [4] is sized to fit tightly into a channel in the piston [2] and the stopper [4] is deformable when it abuts the annular surface inside the piston [2]. This closes the channel.

After the channel(s) have been closed, the case [1] is forced by gas pressure to move relative to the stopper [4] and the piston [2], thereby telescopically expanding the cartridge.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications are covered by the appended claims.

REFERENCES

1. U.S. Pat. No. 5,359,937
2. WO00/09965.
3. U.S. Pat. No. 6,564,719

The invention claimed is:

1. A cartridge for use in a gun, the cartridge comprising a case, a gas generator, a piston, a stopper, and one or more channels for the passage of gas in or around the stopper, wherein the gas generator is located within the case adjacent a first end of the case, and the piston is axially slideably contained in the case, the piston having a first end proximal to the gas generator and a second end distal from the gas generator, and the stopper is slideably contained within the piston for closing the at least one channel, wherein the gas is generated or expelled by the gas generator upon contact with a firing pin of a host gun and initially the gas from the generator can flow through the one or more channels in or around the stopper and exert pressure on a bullet, wherein as the gas pressure rises, the flow of gas past or through the stopper causes the stopper to move thereby shutting the one or more channels and preventing gas flow to the bullet and then to atmosphere.

2. A cartridge according to claim 1, wherein the stopper is capable of shutting the one or more channels and the gas pressure is capable of causing the cartridge to expand to cycle the gun.

3. A cartridge according to claim 1, wherein the case is cylindrical.

4. A cartridge according to claim 1, wherein said piston is hollow.

5. A cartridge according to claim 1, wherein the cartridge comprises a single gas generator.

6. A cartridge according to claim 1, wherein the cartridge further comprises the bullet.

7. A cartridge according to claim 6, wherein the bullet is mounted in or on a recessed seat in a second end of the piston.

8. A cartridge according to claim 7, wherein the one or more channels communicate with the recessed seat.

9. A cartridge according to claim 7, wherein the recessed seat is of a tapering configuration, wherein a trailing end of the bullet is force-fitted into the seat.

10. A cartridge according to claim 1, wherein the stopper is generally cylindrical and the one or more channels are defined axially through the stopper from a first end of the stopper to a second end of the stopper.

11. A cartridge according to claim 10, wherein the cartridge comprises a plurality of channels for the passage of gas through the stopper.

12. A cartridge according to claim 11, wherein the plurality of channels through the stopper are spaced radially equidistant from each other.

13. A cartridge according to claim 10, wherein the channels through the stopper are spaced axially equidistant from each other.

14. A cartridge according to claim 10, wherein the first end of the stopper is located adjacent a first end of the piston in proximity to the gas generator and the first end of the stopper is planar.

15. A cartridge according to claim 10, wherein the second end of the stopper is conical.

16. A cartridge according to claim 15, wherein the one or more channels are defined through the stopper and exit the stopper proximal to the second end adjacent the base of the cone forming the second end.

17. A cartridge according to claim 16, wherein the second end of the stopper is shaped to correspond to an internal surface of the piston.

18. A cartridge according to claim 17, wherein the internal surface of the piston is of relatively soft material.

19. A cartridge according to claim 1, wherein the stopper is generally a disk and the one or more channels are defined axially through the stopper from a first end of the stopper to a second end of the stopper.

20. A cartridge according to claim 19, wherein the cartridge comprises a plurality of channels for the passage of gas through the stopper.

21. A cartridge according to claim 20, wherein the plurality of channels through the stopper are spaced radially equidistant from each other.

22. A cartridge according to claim 20, wherein the plurality of channels through the stopper are spaced axially equidistant from each other.

23. A cartridge according to claim 19, wherein the first end of the stopper is located adjacent a first end of the piston in proximity to the gas generator and the first end of the stopper is planar.

24. A cartridge according to claim 19, wherein the stopper further comprises a member atop the disk.

25. A cartridge according to claim 24, wherein the one or more channels are defined axially through the stopper and exit the stopper through an annular surface of the disk radially distal to the member.

26. A cartridge according to claim 25, wherein the annular surface of the disk abuts an annular surface of the piston and the member is sized to fit tightly into a channel in the piston.

27. A cartridge according to claim 1, wherein the stopper is generally a sphere and a channel is defined around the stopper.

28. A cartridge according to claim 27, wherein the stopper is located adjacent a first end of the piston in proximity to the gas generator.

29. A cartridge according to claim 27, wherein the stopper is sized to fit tightly into a channel in the piston and the stopper is deformable when it abuts an annular surface inside the piston.

* * * * *